US009934768B2

(12) United States Patent
Uemura et al.

(10) Patent No.: US 9,934,768 B2
(45) Date of Patent: Apr. 3, 2018

(54) MUSICAL SCORE DISPLAY CONTROL DEVICE AND METHOD

(71) Applicant: Yamaha Corporation, Shizuoka (JP)

(72) Inventors: Norihiro Uemura, Shizuoka (JP); Motoji Nagata, Shizuoka (JP)

(73) Assignee: YAMAHA CORPORATION, Shizuoka (JP)

( * ) Notice: Subject to any disclaimer, the term of this patent is extended or adjusted under 35 U.S.C. 154(b) by 0 days.

(21) Appl. No.: 15/469,017

(22) Filed: Mar. 24, 2017

(65) Prior Publication Data

US 2017/0287454 A1 Oct. 5, 2017

(30) Foreign Application Priority Data

Mar. 30, 2016 (JP) ..... 2016-067700
Mar. 30, 2016 (JP) ..... 2016-067705

(51) Int. Cl.
*G10G 1/00* (2006.01)
*G10H 1/00* (2006.01)

(52) U.S. Cl.
CPC ..... *G10G 1/00* (2013.01); *G10H 1/0008* (2013.01); *G10H 2220/015* (2013.01)

(58) Field of Classification Search
CPC ..... G10G 1/00
See application file for complete search history.

(56) References Cited

U.S. PATENT DOCUMENTS 8,338,684 B2 * 12/2012 Pillhofer ..... G09B 15/00 84/470 R
9,040,801 B2 5/2015 Hiratsuka
2011/0203442 A1 8/2011 Raveendran
2017/0287454 A1 * 10/2017 Uemura ..... G10G 1/00

FOREIGN PATENT DOCUMENTS

JP 2013-068899 A 4/2013

* cited by examiner

*Primary Examiner* — Robert W Horn
(74) *Attorney, Agent, or Firm* — Global IP Counselors, LLP

(57) ABSTRACT

A musical score display device and method employing a controller that is configured to control a display to display a musical score and, with the musical score, a first time axis corresponding to a performance of the musical score in which at least one repeat part of the musical score is played during the performance, or a second time axis corresponding to the musical score including at least one repeat sign.

8 Claims, 11 Drawing Sheets

MUSICAL SCORE DISPLAY CONTROL DEVICE AND METHOD

CROSS-REFERENCE TO RELATED APPLICATION

This application claims the benefit of Japanese Patent Application No. 2016-067700, filed on Mar. 30, 2016, and Japanese Patent Application No. 2016-067705, filed on Mar. 30, 2016, the entire contents of Japanese Patent Application No. 2016-067700 and Japanese Patent Application No. 2016-067705 being incorporated herein by reference.

BACKGROUND

Field of the Invention

The present invention relates to a musical score display control device and method. More particularly, the present invention relates to a musical score display control device and method which control displaying of a musical score and a time axis pertaining to a performance length of the musical score, with identification of repeats in the musical score, when the musical score is performed or browsed.

Description of the Related Art

A musical score display device that displays a musical score on a display, and automatically updates the display of the musical score according to the playing, etc., of the music that corresponds to the musical score is described, for example, in Japanese Laid-Open Patent Publication No. 2013-68899.

SUMMARY

In addition to displaying a musical score, when the musical score includes repeat signs, it is desirable to inform a user of the current playing position by displaying a time axis that represents the length of the entire musical piece when the musical score is actually performed with the repeat signs played out, and the current playing position. However, if only a time axis that represents the length of the entire musical piece when the musical score is actually performed and the current playing position are displayed, it is not easy for the user to recognize visually, for example, how many iterations of the performance there have been. In addition, if the user designates a specific position in the musical score, such as a position where the user desires to repeatedly listen, and a position corresponding to the designated position is displayed by a mark, or the like, on a time axis that represents the entire musical piece, the user is able to ascertain the designated position on the musical score within the entire time axis, thereby improving user convenience.

In view of the foregoing, an object of the present invention is to provide a musical score display control method, device and program which assists a user in easily understanding, for example, the relationship between a musical score and a time axis that represents the length of the entire musical piece when the musical score is actually performed.

In a musical score display method according to disclosed embodiments, a musical score image information generation section generates musical score image information for displaying a musical score based on musical score data that represent a musical score. Furthermore, a first time axis information generation section generates first time axis information for displaying a time axis corresponding to the actual performance in which the repeat parts of the musical score are played out. In addition, a display controller controls a display to display a first plurality of repeat parts identification information that indicate positions corresponding to the repeat parts in the first time axis information.

The musical score display device according to disclosed embodiments comprises a musical score image information generation section that generates musical score image information for displaying a musical score based on musical score data that represent a musical score. The musical score display device further comprises a first time axis information generation section that generates first time axis information for displaying a time axis corresponding to the actual performance in which the repeat parts of the musical score are played out, and a display controller that controls a display to display a first plurality of repeat parts identification information which indicate positions corresponding to the repeat parts in the first time axis information.

The musical score display program according to disclosed embodiments causes a computer to function as a musical score image information generation section that generates musical score image information for displaying a musical score based on musical score data that represent a musical score. The musical score display program also causes the computer to function as a first time axis information generation section that generates first time axis information for displaying a time axis corresponding to the actual performance in which the repeat parts of the musical score are played out, and as a display controller that controls a display to display a first plurality of repeat parts identification information which indicate positions corresponding to the repeat parts in the first time axis information.

In view of the above objects, disclosed embodiments provide a musical score display device and method employing a controller that is configured to control a display to display a musical score and, with the musical score, a first time axis corresponding to a performance of the musical score in which at least one repeat part of the musical score is played during the performance, or a second time axis corresponding to the musical score including at least one repeat sign.

Another object of the present invention is to provide a musical score display control method, device and program that are capable of improving user convenience in the manner described above.

In a musical score display control method according to disclosed embodiments, a time axis information generation section generates first time axis information that presents a first time axis corresponding to an actual performance in which a repeat part in a musical score that is displayed on a display is played out, based on musical score data that represents a musical score corresponding to a musical piece represented by music data. A designated position information acquisition section acquires designated position information that represents a predetermined position in the musical score that is displayed on the display based on the musical score data according to a designation by a user. A display controller controls a display to display a predetermined mark in a corresponding position in the first time axis information, based on the designated position information and reference data with which the music data and the musical score data are associated.

The musical score display controller according to disclosed embodiments comprises a time axis information generation section that generates first time axis information that presents a first time axis corresponding to an actual performance in which a repeat part in a musical score that is displayed is played out, based on musical score data representing the musical score that corresponds to a musical piece represented by music data. The musical score display control device further comprises a display that displays a musical score based on the musical score data, and a designated position information acquisition circuit that acquires designated position information representing a predetermined position in the musical score that is displayed on the display according to a designation by a user. The musical score display control device further comprises a display controller that controls the display to display a predetermined mark to be displayed in a corresponding position in the first time axis information, based on the designated position information and reference data with which the music data and the musical score data are associated.

The musical score display control program according to disclosed embodiments causes a computer to function as a time axis information generation section that generates first time axis information that presents a first time axis that corresponds to an actual performance in which a repeat part in a musical score that is displayed is played out, based on musical score data representing a musical score that corresponds to a musical piece represented by music data. The musical score display control program further causes the computer to control a display to display a musical score based on the musical score data, and as a designated position information acquisition circuit that acquires designated position information representing a predetermined position in the musical score that is displayed on the display according to a designation by a user. The musical score display control program further causes the computer to function as a display controller that controls the display to display a predetermined mark to be displayed in a corresponding position in the first time axis information, based on the designated position information and reference data with which the music data and the musical score data are associated.

BRIEF DESCRIPTION OF THE DRAWINGS

Referring now to the attached drawings which form a part of this original disclosure.

Figure 1:
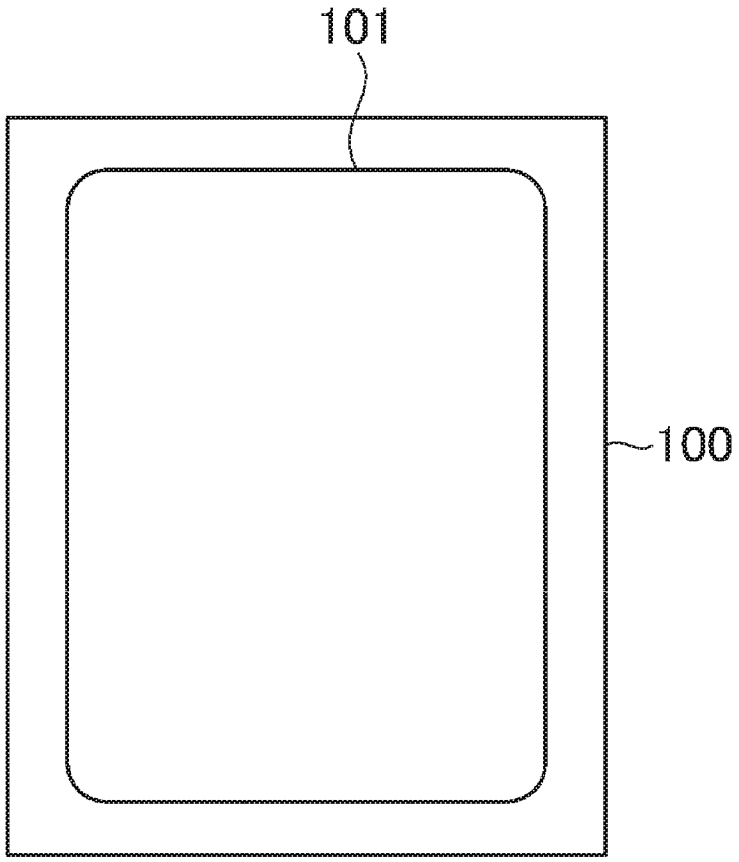
FIG. 1 illustrates an example of a display control device according to a disclosed embodiment.

It should be noted that these figures are intended to illustrate the general characteristics of methods and structure utilized in the illustrative embodiment and to supplement the written description provided below. These drawings may not precisely reflect the precise structural or performance characteristics of any given embodiment, and should not be interpreted as defining or limiting the range of values or properties encompassed by illustrative embodiments unless specified.

DETAILED DESCRIPTION OF EMBODIMENTS

Selected embodiments will now be explained with reference to the drawings. It will be apparent to those skilled in the music field from this disclosure that the following descriptions of the embodiments are provided for illustration only and not for the purpose of limiting the invention as defined by the appended claims and their equivalents. Like reference numerals in the drawings denote like similar or identical elements or features, and thus the descriptions of the similar or identical elements or features can be omitted in later embodiments.

FIG. 1 is a view showing one example of a musical score display control device 100 according to a disclosed embodiment. The musical score display control device 100 comprises a display 101 (e.g., a touch panel). Information can be input to the musical score display control device 100 by, for example, a user performing a contact operation on the display 101 with a finger or the like (hereinafter referred to as "touch"). Specifically, the musical score display control device 100 corresponds to a mobile electronic device, such as a PDA (Personal Digital Assistant), a mobile terminal, a smart phone, a tablet computer, and any other suitable type of device as understood in the art. For example, a smart phone or tablet computer can use an application that enables the smart phone or tablet computer to operate as the musical score display control device 100 as described herein. Moreover, the display 101 can include, for example, electrostatic capacitive coupling components that detect changes in capacitance of the touched portion, a resistance film that detects changes in resistance, a light sensor that detects changes in the amount of light of the portion that is shielded by touch, or the like.

Figure 2:
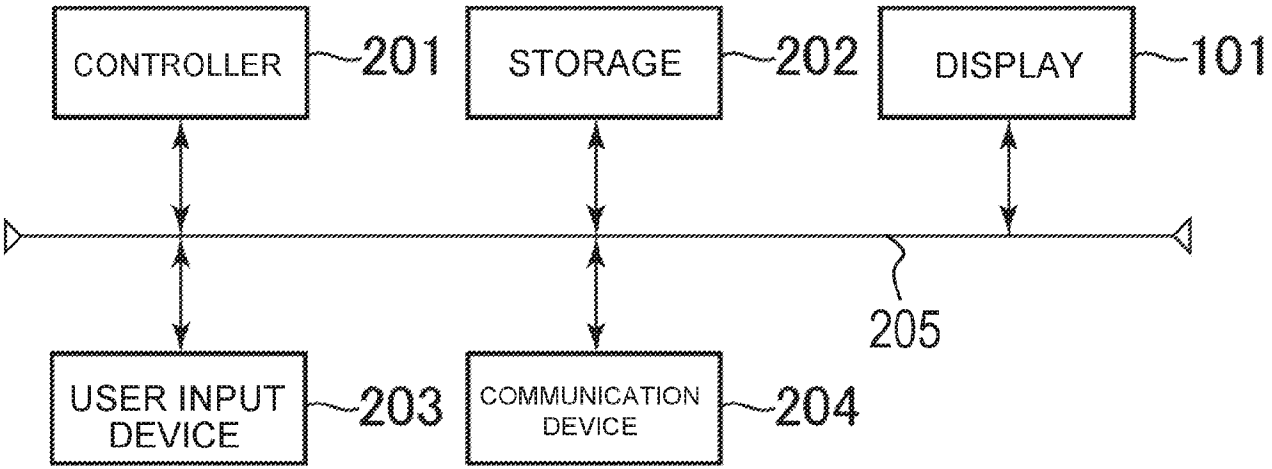
FIG. 2 is a block diagram illustrating an example of a hardware configuration of the display control device shown in FIG. 1.

FIG. 2 is a block diagram illustrating an example of the hardware configuration of the musical score display device 100. As shown in FIG. 2, the musical score display control device 100 comprises a controller 201, a storage 202, a user input device 203, a display 101, and a communication device 204. Moreover, each of the controller 201, the storage 202, the user input device 203, the communication device 204 and the display 101 are connected to each other by, for example, an internal bus 205 or in any other suitable manner.

The controller 201 includes, for example, a CPU, which operates according to a program that is stored in, for example, the storage 202. As understood in the art, the CPU preferably includes a microcomputer with a control program that controls the musical score display control device 100 as discussed herein. The CPU can also include other conventional components such as an input interface circuit, an output interface circuit, and storage devices such as a ROM (Read Only Memory) device and a RAM (Random Access Memory) device. The RAM and ROM store processing results and control programs that are run by the CPU. The CPU is operatively coupled to the components of the musical score display control device 100 as appropriate, in a conventional manner. It will be apparent to those skilled in the art from this disclosure that the precise structure and algorithms for the CPU can be any combination of hardware and software, such as an application, that will carry out the functions of the present invention. The storage 202 is configured from information storage media such as ROM, RAM, and a hard disk, and is an information storage medium that holds programs that are executed by the controller 201. In addition, the storage 202 also operates as a work memory of the controller 201. Moreover, the programs can be provided by downloading via a network, or provided by various information storage media that can be read by a computer, such as a CD-ROM, a DVD-ROM or any other suitable storage medium as known in the art.

The user input device 203 can be configured, for example, as a so-called touch panel integrated with the display 101 described below, and outputs the content of an instruction operation to the controller 201, according to the instruction operation by the user. The display 101 can be, for example, a liquid-crystal display, an organic EL display, or any other suitable type of display, and displays information in accordance with instructions from the controller 201. The communication device 204 communicates with an external device (not shown). Moreover, while the user input device 203 and the display 101 are shown separately in FIG. 2, in the present embodiment, for example, the user input device 203 and the display 101 are integrally formed as a touch panel. Further, the present embodiment can be configured so as to comprise a button, knob, switch or any other suitable component as a user input device 203 instead of a touch panel.

Figure 3:
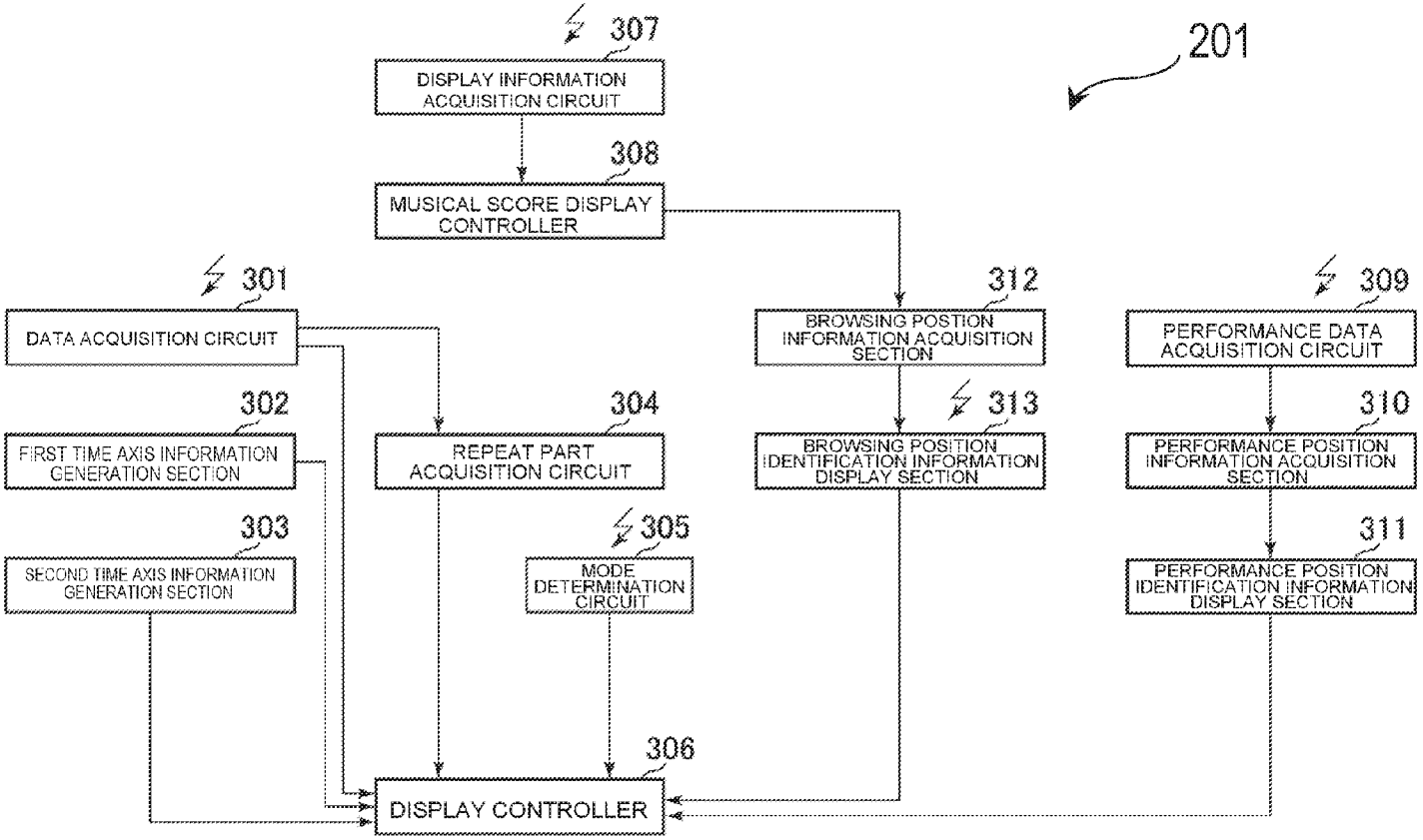
FIG. 3 is a block diagram illustrating an example of a functional configuration of the controller shown in FIG. 2.

One example of a functional configuration of the controller 201 shown in FIG. 2 will be described with reference to FIG. 3. A data acquisition circuit 301 acquires, for example, musical score data, music data, and reference data. The musical score data can be, for example, image data or MusicXML data that represent a musical score. Music data are, for example, MIDI data, audio data, and video data. Reference data are, for example, data with which music data and musical score data that correspond to a certain musical piece are associated, and data with which at least position information in a musical score indicated by the musical score data and playing position information (time information) indicated by the music data are associated. Moreover, if the musical score data are image data, the data acquisition circuit 301 can generate music data and generate reference data by carrying out image recognition of symbols such as musical notes from image data that represent a musical score. Furthermore, the musical score display device 100 in the present embodiment can be configured to comprise a camera, and to acquire image data of a musical score by photographing a musical score. Also, if the musical score data are MusicXML data, the data acquisition circuit 301 can generate music data and reference data based on the MusicXML data.

Figure 4:
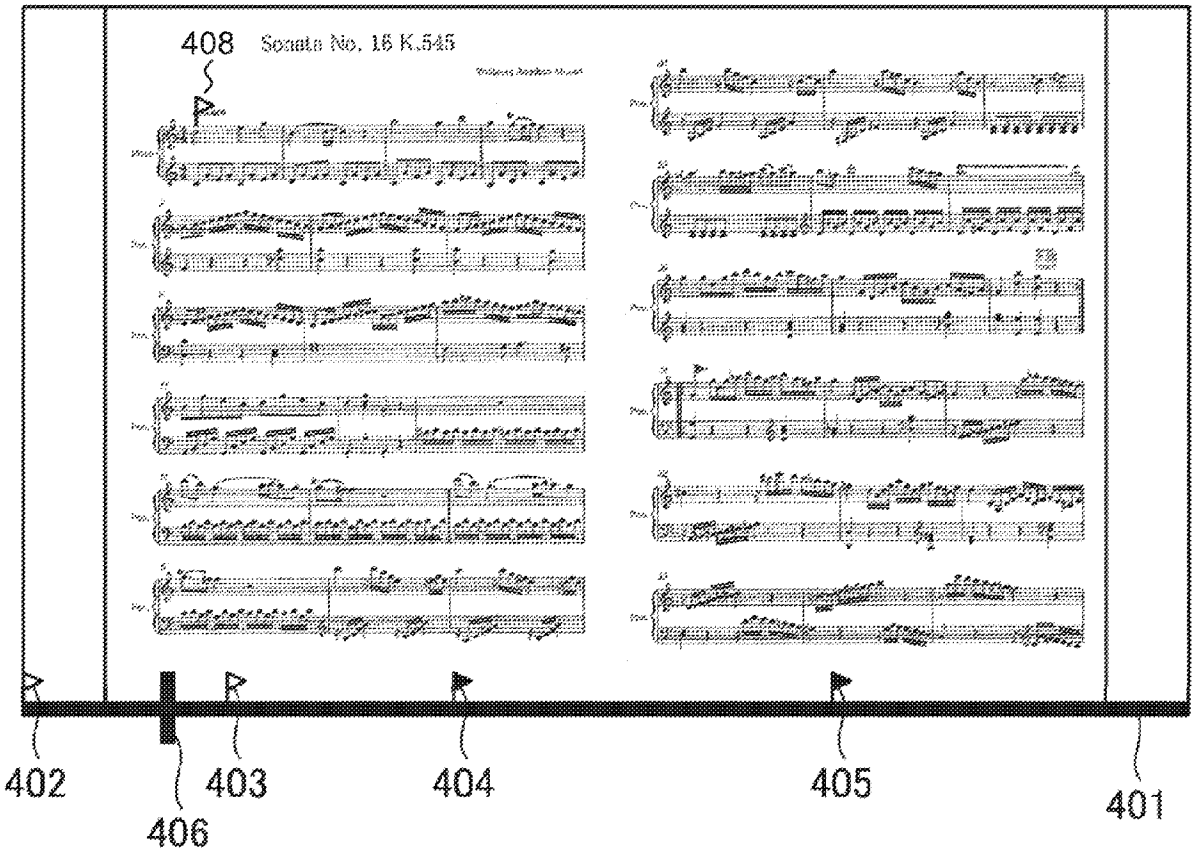
FIG. 4 illustrates an example of a musical score including first time axis information.

A first time axis information generation section 302 generates first time axis information based on the music data. In this example, the first time axis information corresponds to information for displaying a time axis that corresponds to the actual performance in which repeat parts that are repeated are played out based on repeat signs that are included in the musical score. For example, the first time axis information 401 is bar-like and is displayed at the bottom of the musical score, etc., as shown in FIG. 4. Moreover, the shape, size, and display position, etc., of the first time axis information 401 shown in FIG. 4 are examples, and can be of other shapes, such as circular, and sizes, and occupy other display positions.

Figure 5:
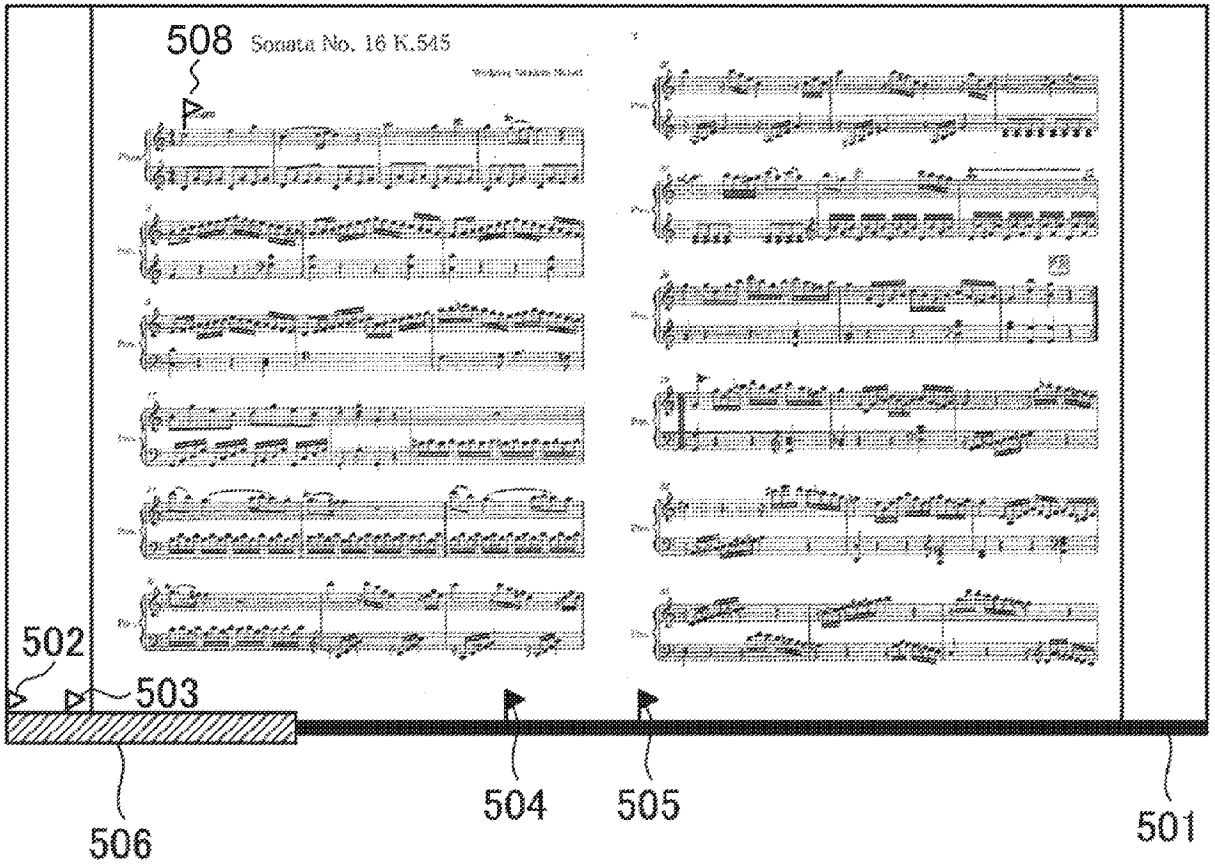
FIG. 5 illustrates an example of a musical score including second time axis information.

A second time axis information generation section 303 generates second time axis information based on the musical score data. In this example, the second time axis information corresponds to information for displaying a time axis corresponding to the musical score itself, in which repeat signs that are included in the musical score are not played out. In other words, the second time axis information corresponds to information that displays an axis that corresponds to the length of the musical score itself. For example, the second time axis information 501 is bar-like and is displayed on the bottom of the musical score, etc., as shown in FIG. 5. Moreover, the shape, size, and display position, etc., of the second time axis information 501 shown in FIG. 5 are examples, and can be of other shapes, such as circular, and sizes, and occupy other display positions.

A repeat part acquisition circuit 304 acquires repeat part information that represents repeat parts. For example, the repeat part acquisition circuit 304 can be configured to acquire position information that represents the position of a repeat part on the musical score based on repeat signs in the musical score data. Furthermore, the repeat part acquisition circuit 304 can be configured, for example, to identify repeat part position information that represents a repeat part in the music data, by identifying repeat parts in the music data.

A mode determination circuit 305 determines whether the mode is a musical score tracking mode or a musical score browsing mode. In this example, the musical score tracking mode corresponds to a mode in which a display of the corresponding musical score is automatically updated according to the progress of the performance that corresponds to the musical score. The updating of the musical score display will be described below. Further, the mode determination circuit 305 is configured, for example, to determine whether the mode is the musical score tracking mode or the musical score browsing mode based on a selection instruction of the user or in any other suitable manner.

As discussed in more detail below, when the mode determination circuit 305 determines that the mode is a musical score tracking mode, the repeat part acquisition circuit 304 identifies repeat part position information that represents a position corresponding to the repeat part in the first time axis information, based on the position information of the repeat part. Furthermore, when the mode determination circuit 305 described below determines that the mode is a musical score browsing mode, the repeat part acquisition circuit 304 identifies repeat part position information that represents a position corresponding to the repeat part in the second time axis information, based on the position information of the repeat part. Then, as described below, predetermined repeat part identification information, which represents the repeat part in the specified position, is displayed on the first or the second time axis information. Moreover, although a case was described in the foregoing description in which repeat part identification information, representing a position corresponding to the repeat part, is displayed on the first or the second time axis information according to the determination result of the mode determination circuit 305, the repeat part identification information in each of the first and the second time axis information can be displayed regardless of the determination result.

A display controller 306 displays the first time axis information on the display 101, when the mode determination circuit 305 determines that the mode is the musical score tracking mode, and displays the second time axis information when the mode is determined to be the musical score browsing mode. Moreover, the configuration can be such that the first time axis information or the second time axis information is displayed according to a selection instruction of the user, regardless of the determination result of the mode determination circuit 305.

Furthermore, the display controller 306 displays repeat part identification information on the first or the second time axis information based on repeat part position information that is acquired by the repeat part acquisition circuit 304. That is, the display controller 306 controls the display 101 to display a first plurality of repeat parts identification information that indicates positions corresponding to repeat parts of a musical score in the first time axis information, or displays second repeat part identification information that indicates a position corresponding to the repeat part of a musical score in the second time axis information.

Figure 6:
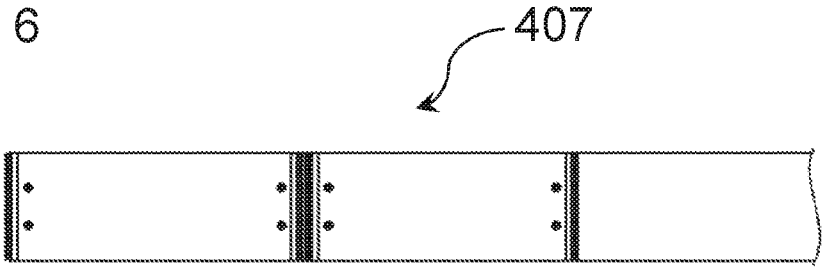
FIG. 6 illustrates an example of the repeat part identification information in the first time axis information.

As shown, for example, in FIG. 4, the display controller 306 indicates flags 402, 403, 404, 405 that identify the initial position of each repeat part in the musical score on the first time axis information 401. The repeat part identification information can be configured to be displayed differently for each number of iterations. Moreover, the repeat part identification information shown in FIG. 4 is an example, and the configuration can be such that, for example, repeat signs in the musical score are also displayed on the first time axis information, as shown in the repeat sign display 407 of FIG. 6. In addition, the configuration can be such that both the repeat sign display 407 and the flags 402, 403, 404, 405 are displayed. Furthermore, as shown in FIG. 4, the configuration can be such that the initial position of the repeat part in the musical score is displayed using a flag 408. The flag 408 can be configured to be displayed with a shape, etc., that corresponds to the shape, etc., of the flag (e.g., flag 402) on the first time axis information.

Figure 7:
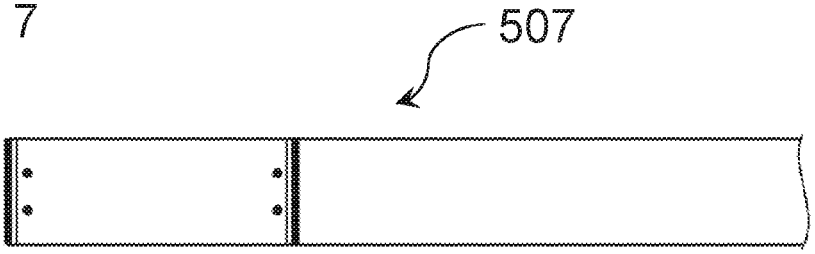
FIG. 7 illustrates an example of the repeat part identification information in the second time axis information.

As shown, for example, in FIG. 5, the display controller 306 indicates flags 502, 503, 504, 505, etc., for identifying the first and the last positions of the repeat parts of the musical score on the second time axis information. Moreover, the repeat part identification information shown in FIG. 5 is an example, and the configuration can be such that, for example, repeat signs in the musical score are displayed in the corresponding positions in the second time axis information, as shown in the repeat sign display 507 of FIG. 7. In addition, the configuration can be such that both the repeat sign display 507 and the flags 502, 503, 504, 505 are displayed. Furthermore, as shown in FIG. 5, the configuration can be such that the initial position of the repeat part in the musical score is displayed using a flag 508. The flag 508 can be configured to be displayed with a shape, etc., that corresponds to the shape, etc., of the flag (e.g., flag 502) on the first time axis information.

Referring back to FIG. 3, a display information acquisition circuit 307 acquires display unit information, which represents the unit of display of the musical score that is displayed on the display 101, such as one page at a time, two pages at a time, or the like. Moreover, for example, when a portion of one page of the musical score is enlarged and displayed, the unit of display can be half a page at a time, or the like.

A musical score display controller 308 displays the musical score that is represented by the musical score data on the display 101, based on the display unit information that is acquired by the display information acquisition circuit 307. For example, FIG. 4 shows a state in which the first page and the second page of the musical score are displayed on the display 101, when the unit of display is two pages at a time. Furthermore, when in the musical score tracking mode, the musical score display controller 308 controls the display 101 to display a portion of the musical score that includes the current performance position according to the display unit information. For example, as described above, when the unit of display is two pages at a time, if a portion of the third page is being performed, the third page and the fourth page of the musical score are displayed, etc. In this manner, the display of the corresponding musical score is automatically updated according to the progress of the performance that corresponds to the musical score.

In addition, a performance data acquisition circuit 309 acquires performance data. In this example, performance data are data based on the playing of an instrument, or the like, by the user, and correspond to, for example, musical sound data that are based on the playing of an instrument. For instance, the performance data can correspond to musical sound information that represents each musical sound, when the instrument is an electronic instrument such as an electronic piano.

The performance position information acquisition section 310 acquires performance position information that represents the current performance position in the first time axis information, based on the performance data acquired by the performance data acquisition circuit 309. For example, the performance position information acquisition section 310 analyzes the acquired performance data, and identifies the current performance position in the music data. Then, the performance position information that represents the performance position in the first time axis information is acquired by identifying the corresponding current performance position in the first time axis information, based on the performance position in the music data.

A performance position identification information display section 311 causes the display controller 306 to control the display 101 to display performance position identification information on the first time axis information, in a position indicated by the performance position information that is acquired by the performance position information acquisition section 310. For example, as shown in FIG. 4, performance position identification information 406 that represents the current performance position is displayed. Moreover, although the performance position identification information 406 shown in FIG. 4 is one example, the disclosed embodiments are not limited to this example, and other shapes, sizes and so on of the performance position identification information 406 can be employed as well.

In addition, a browsing position information acquisition section 312 acquires browsing position information that represents the current browsing position in the musical score. Specifically, the browsing position information acquisition section 312 acquires browsing position information based on musical score data that are currently displayed on the display 101. For example, when the unit of display to the display 101 represents a length of two pages and the first page and the second page are displayed, the browsing position information acquisition section 312 acquires browsing position information that represents the first page to the second page in the musical score data browsing position information.

A browsing position identification information display section 313 causes the display controller 306 to control the display 101 to display browsing position identification information on the second time axis information, in a position indicated by the browsing position information that is acquired by the browsing position information acquisition section 312. For example, as shown in FIG. 5, since the first page and the second page of the musical score are displayed, the browsing position identification information 506 is displayed on the second time axis information, in a position that corresponds to the first page in the musical score data. Moreover, the shape, size, etc., of the browsing position identification information shown in FIG. 5 is an example, and other shapes, sizes, etc., can be used.

Figure 8:
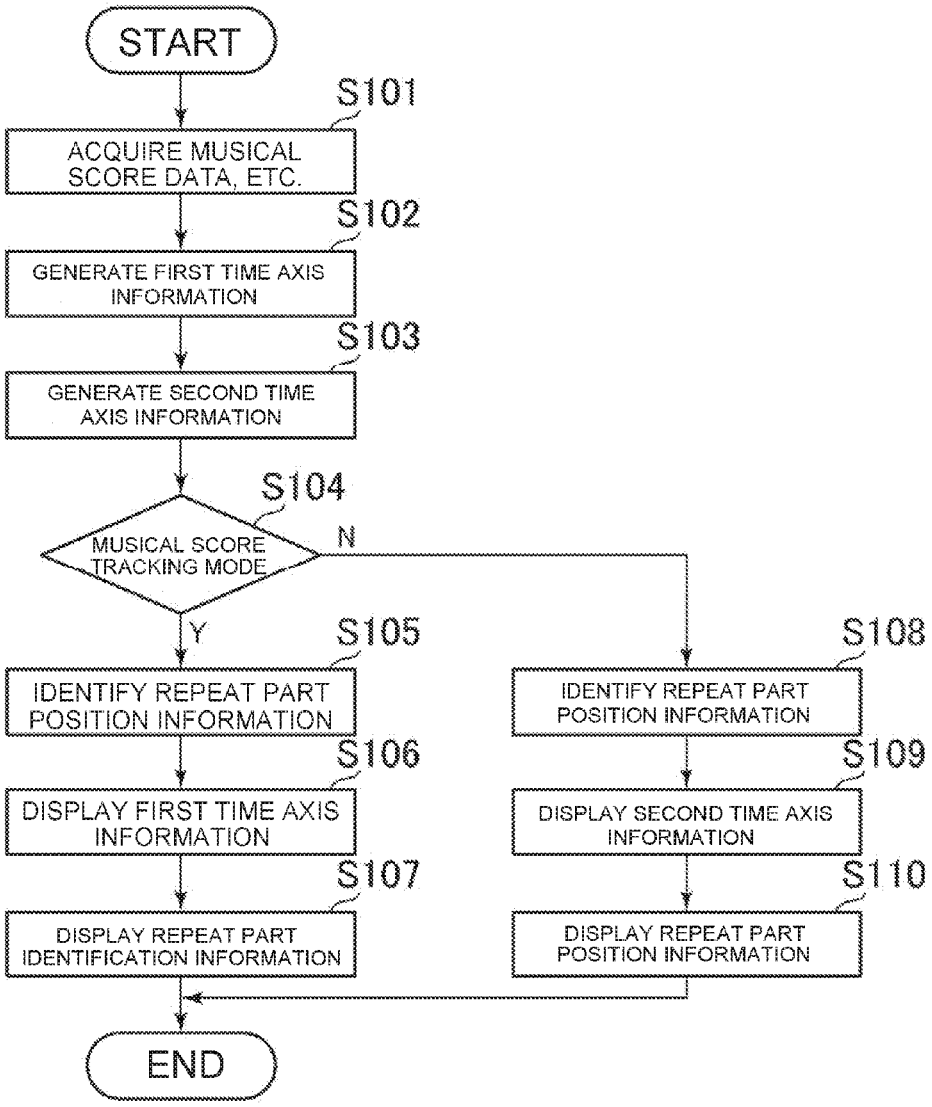
FIG. 8 is a flow chart illustrating an example of operations performed by the musical score display control device according to disclosed embodiments.

An example of a process performed by the musical score display control device 100 according to the disclosed embodiments will now be described with reference to FIG. 8. To simplify the explanation, a case in which the repeat part identification information is displayed on the first or the second time axis information will primarily be described below.

In Step S101, the data acquisition circuit 301 acquires musical score data, etc. In Step S102, the first time axis information generation section 302 generates first time axis information as discussed above. In Step S103, the second time axis information generation section 303 generates second time axis information as discussed above. In Step S104, the mode determination circuit 305 determines whether the mode is a musical score tracking mode or a musical score browsing mode as discussed above. When the mode determination circuit 305 determines that the mode is a musical score tracking mode, the repeat part acquisition circuit 304 in Step S105 acquires repeat part information that represents the repeat part, and identifies repeat part position information that represents a position corresponding to the repeat part in the first time axis information, based on the repeat part position information. In Step S106, the display controller 306 controls the display 101 to display the first time axis information on the display 101 as discussed above. Also, in Step S107, the display controller 306 controls the display 101 to display repeat part identification information on the first time axis information based on repeat part position information that is acquired by the repeat part acquisition circuit 304 as discussed above, and the process ends.

However, when the mode determination circuit 305 determines in Step S104 that the mode is a musical score browsing mode, the repeat part acquisition circuit 304 in Step S108 acquires repeat part information that represents the repeat part and identifies repeat part position information that represents a position corresponding to the repeat part in the second time axis information based on the repeat part position information as discussed above. In Step S109, the display controller 306 controls the display 101 to display the second time axis information on the display 101 as discussed above. In Step S110, the display controller 306 controls the display 101 to display repeat part identification information on the second time axis information based on repeat part position information that is acquired by the repeat part acquisition circuit 304 as discussed above, and the process ends.

The present invention is not limited to the embodiments described above, and can be replaced by a configuration that is substantially the same, a configuration that realizes the same action and effect, or a configuration that is capable of achieving the same object as the configuration shown in the above-described embodiment. For example, in the process shown in FIG. 8, an example of a case is described in which the second time axis information is generated after the first time axis information is generated. However, the configuration can be such that the first and second time axes information are generated in a different order or simultaneously.

In addition, as described above, the first time axis information or the second time axis information is displayed depending on whether the mode is the musical score tracking mode or the musical score browsing mode. However, the configuration can be such that the display controller 306 controls the display 101 to display the first time axis information or the second time axis information according to an instruction from the user, regardless of whether the mode is the musical score tracking mode or the musical score browsing mode. Also, the configuration can be such that the first time axis information and the second time axis information are displayed according to an instruction from the user. Furthermore, as described above, the repeat part identification information is displayed after the first or the second time axis information is displayed. However, the configuration can be such that the first and second time axes are displayed simultaneously, or the configuration can be such that a first or the second time axis information that includes repeat part identification information is generated, and the first or the second time axis information is displayed thereafter.

Figure 9:
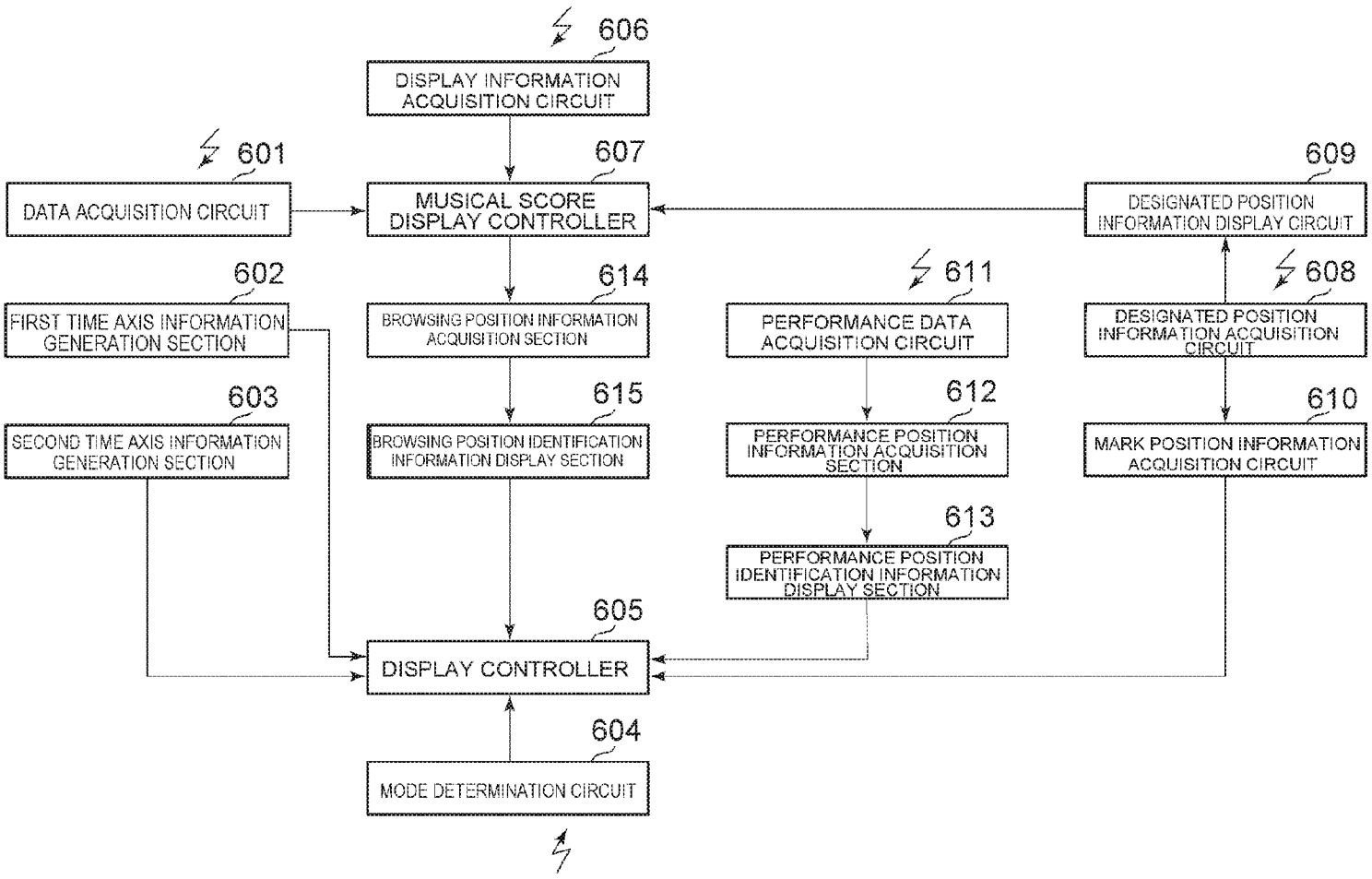
FIG. 9 is a block diagram illustrating an example of an additional functional configuration of the controller shown in FIG. 2.

An example of another functional configuration of the controller 201 shown in FIG. 2 will be described with reference to FIG. 9. Except for the additional features discussed below, the configurations and operations of data acquisition circuit 601, first time axis information generation section 602, second time axis information generation section 603, mode determination circuit 604, display controller 605, display information acquisition circuit 606, musical score display controller 607, performance data acquisition circuit 611, performance position information acquisition section 612, and performance position identification information display section 613 are the same as for the data acquisition circuit 301, first time axis information generation section 302, second time axis information generation section 303, mode determination circuit 305, display controller 306, display information acquisition circuit 307, musical score display controller 308, performance data acquisition circuit 309, performance position information acquisition section 310, and performance position identification information display section 311, respectively, as discussed above. Therefore, descriptions of the duplicate configurations and operations of these components are not repeated in full detail below.

The data acquisition circuit 601 acquires, for example, musical score data, music data, and reference data in a manner similar to data acquisition circuit 301 discussed above. The first time axis information generation section 602 generates first time axis information based on the music data in a manner similar to the first time axis information generation section 302 discussed above, and the second time axis information generation section 603 generates second time axis information based on the musical score data in a manner similar to the second time axis information generation section 303 discussed above.

The mode determination circuit 604 determines whether the mode is a musical score tracking mode or a musical score browsing mode in a manner similar to mode determination circuit 305 discussed above. That is, the musical score tracking mode corresponds to a mode in which a display of the corresponding musical score is automatically updated according to the progress of the performance that corresponds to the musical score. The updating of the musical score display is described below. In addition, the musical score browsing mode is a mode for browsing a musical score. As discussed in more detail below, the musical score browsing mode is a mode that displays a time axis that corresponds to the musical score itself in which repeat signs in the musical score are not played out. Moreover, the mode determination circuit 604 is configured, for example, to determine whether the mode is the musical score tracking mode or the musical score browsing mode based on a selection instruction of the user.

The display controller 605 displays the first time axis information on the display 101, when the mode determination circuit 604 determines that the mode is the musical score tracking mode, and displays the second time axis information when the mode is determined to be the musical score browsing mode, in a manner similar to mode determination circuit 305. Moreover, the display controller 605 displays a predetermined mark corresponding to an instruction from the user on the first or the second time axis information, as described below. In addition, the configuration may be such that the first time axis information or the second time axis information is displayed according to a selection instruction of the user, regardless of the determination result of the mode determination circuit 604.

As with the display information acquisition circuit 307, the display information acquisition circuit 606 acquires display unit information, which represents the unit of display of the musical score that is displayed on the display 101, such as one page at a time, two pages at a time, or the like. Moreover, for example, when a portion of one page of the musical score is enlarged and displayed, the unit of display may be half a page, or the like.

Figure 10:
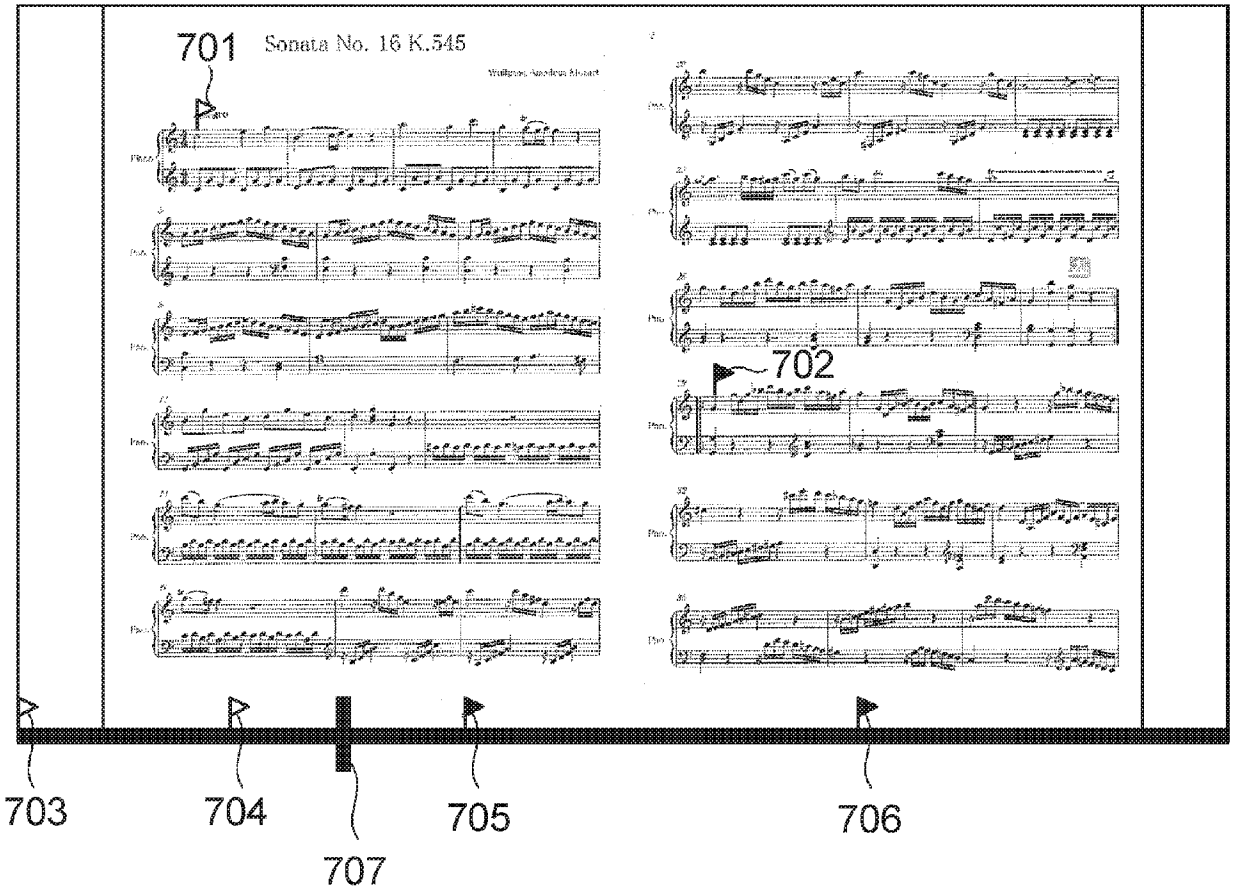
FIG. 10 illustrates an example of a musical score displayed on a display screen in a musical score tracking mode.

A musical score display controller 607 controls the display 101 to display the musical score that is represented by the musical score data, based on the display unit information that is acquired by the display information acquisition circuit 606. For example, FIG. 10 shows a state in which the first page and the second page of the musical score are displayed on the display 101 when the unit of display is two pages at a time. Furthermore, when in the musical score tracking mode, the musical score display controller 307 performs a control such that a portion of the musical score that includes the current performance position is displayed according to the display unit information. For example, as described above, when the unit of display is two pages at a time, if a portion of the third page is being performed, the third page and the fourth page of the musical score are displayed, etc. In this manner, the display of the corresponding musical score is automatically updated according to the progress of the performance that corresponds to the musical score.

A designated position information acquisition circuit 808 acquires designated position information that represents a position on the musical score that is designated by the user. Further, a designated position information display circuit 309 causes the musical score display controller 607 to control display 101 to display designated position identification information that indicates the designated position on the musical score. For example, as shown in FIG. 10, if the user uses the user input device 203 and designates desired positions on the musical score (the two positions indicated by the flags 701 and 702), the designated position information acquisition circuit 608 acquires the designated position information that represents the positions corresponding to the designation. Then, the designated position information display circuit 609 causes the musical score display controller 607 to control display 101 to displays the flags 701 and 702 as the designated position identification information that indicates the designated positions. Moreover, although the designated position identification information shown in FIG. 10 is one example, the shapes, etc., of the designated position information are not limited to the shapes, etc., as shown. Furthermore, as shown in FIG. 10, the configuration may be such that the user can designate a multiplicity of positions, and if a multiplicity of positions is designated, each piece of designated position identification information that represents the multiplicity of positions is distinguished and displayed in a different color.

Figure 11:
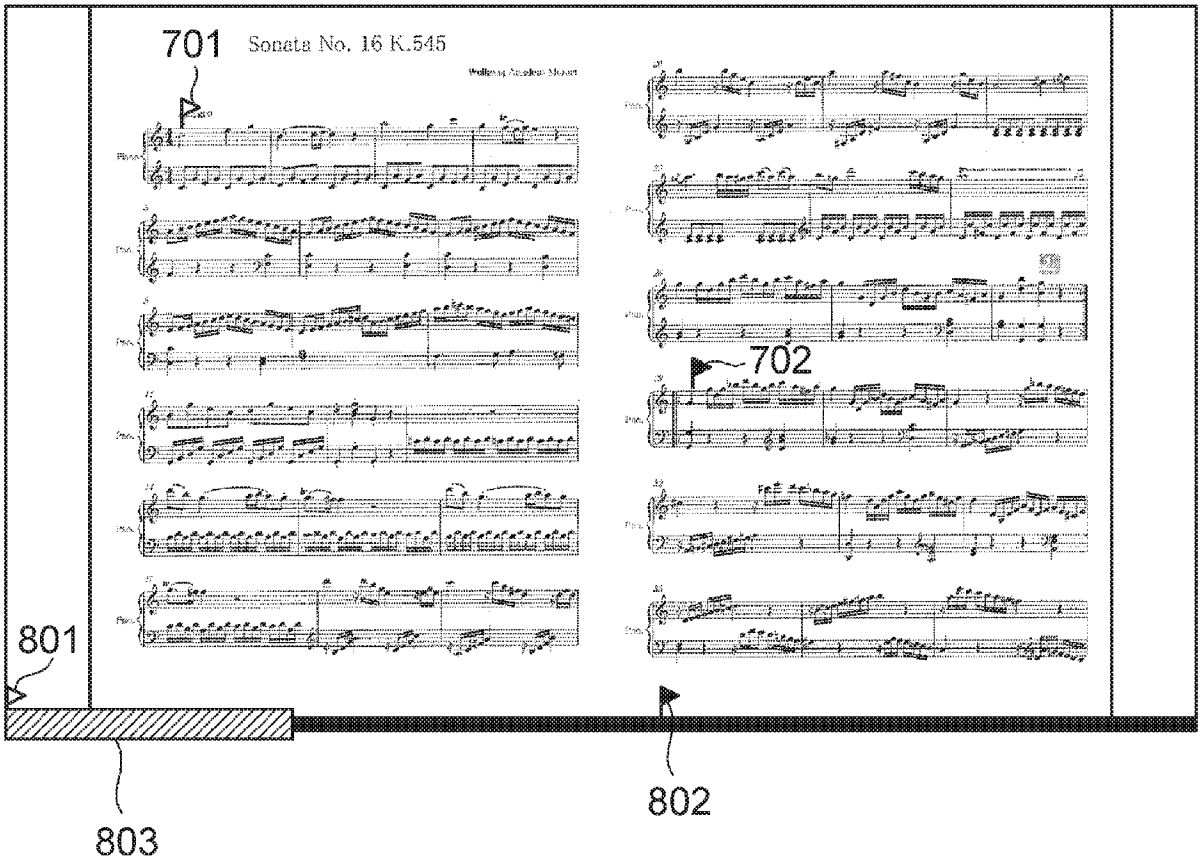
FIG. 11 illustrates an example of a musical score displayed on a display screen in a musical score browsing mode.

The mark position information acquisition circuit 310 acquires mark position information that represents the position information that corresponds to the positions on the musical score in the first time axis information and the second time axis information, based on the designated position information that is acquired by the designated position information acquisition circuit 608. For example, if a repeat sign is included in the musical score, since the repeat part in the musical score is played out in the first time axis information, as described above, mark position information corresponding to the number of iterations is acquired, and a multiplicity of predetermined marks corresponding to the number of iterations is displayed in positions indicated by the mark position information by the display controller 605, as described below. For example, as shown in FIG. 10, since predetermined positions (two positions indicated by the flags 701 and 702) are designated, which are included in the repeat part represented by a repeat sign (repeat) indicating one repeat, two marks 704 and 706 are respectively displayed in the first time axis information. On the other hand, in the second time axis information as shown in FIG. 11, since the repeat part is not played out, marks 801 and 802 corresponding to flags 701 and 702, respectively, are displayed in the second time axis information as controlled by the display controller 605.

Moreover, the marks 703 through 706, 801, and 802 may be the same marks as flags 701 and 702. Furthermore, in a case in which two marks 704 and 705 are displayed in the first time axis information with respect to one flag 701, the configuration may be such that the mark 704 included in the portion that is performed the first time, and the mark 705 that is included in the portion that is played the second time, are distinguished and displayed.

Thus, as described above, the display controller 605 displays a predetermined mark in a position in the first time axis information or the second time axis information indicated by the mark position information, according to the determination result of the mode determination circuit 604.

Turning back to FIG. 9, performance data acquisition circuit 611 acquires performance data in a manner similar to performance data acquisition circuit 309. In this example, performance data are data based on the playing of an instrument, or the like, by the user, and correspond to, for example, musical sound data that are based on the playing of an instrument. Furthermore, the performance data may be configured, for example, to correspond to musical sound information that represents each musical sound, when the instrument is an electronic instrument such as an electronic piano.

The performance position information acquisition section 612 acquires performance position information that represents the current performance position in the first time axis information, based on the acquired performance data, in a manner similar to the performance position information acquisition section 310. For example, the performance position information acquisition section 612 analyzes the acquired performance data and identifies the current performance position in the music data. Then, the performance position information that represents the performance position in the first time axis information is acquired by identifying the corresponding current performance position in the first time axis information, based on the performance position in the music data.

The performance position identification information display section 613 causes the display controller 605 to control the display 101 to display performance position identification information on the first time axis information, in a position indicated by the performance position information that is acquired by the performance position information acquisition section 612. For example, as shown in FIG. 10, performance position identification information 707 that represents the current performance position is displayed. Moreover, although the performance position identification information 707 shown in FIG. 10 is one example, the disclosed embodiments are not limited to this type of identification information, and other shapes and sizes can be employed as well.

The browsing position information acquisition section 614 acquires browsing position information that represents the current browsing position. Specifically, the browsing position information acquisition section 614 acquires browsing position information based on musical score data that is currently displayed on the display 101. For example, when the unit of display to the display 101 has a length of two pages and the first page and the second page are displayed, the browsing position information acquires browsing position information that represents the first page to the second page in the musical score data.

The browsing position identification information display section 315 causes the display controller 605 to control the display 101 to display browsing position identification information on the second time axis information in a position corresponding to the browsing position information that is acquired by the browsing position information acquisition section 314. For example, in the case shown in FIG. 11, since the first page and the second page of the musical score are displayed, the browsing position identification information 803 is displayed on the second time axis information in a position that corresponds to the first page in the musical score data. Moreover, the shape, size, etc., of the browsing position identification information shown in FIG. 11 is an example, and may be of other shapes, sizes, etc.

Next, an example of a process performed by the musical score display control device 100 according to the embodiments discussed with regard to FIGS. 9 through 11 for displaying mark position information in the first or the second time axis information will be described with reference to the flowchart in FIG. 12.

Figure 12:
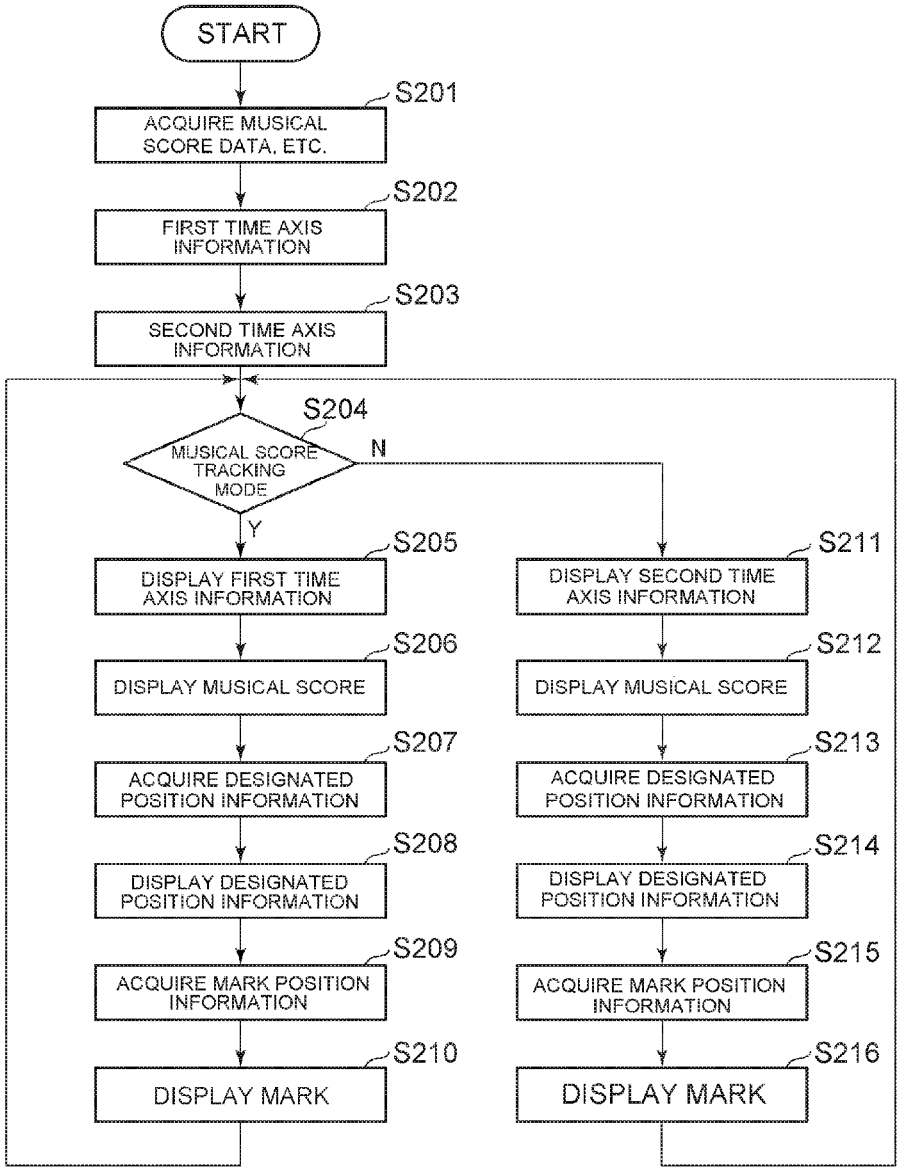
FIG. 12 is a flow chart illustrating an example of operations performed by the musical score display control device to display mark position information in first or second time axis information according to additional disclosed embodiments.

As shown in FIG. 12, the data acquisition circuit 601 acquires musical score data in Step S201. In Step S202, the first time axis information generation section 602 generates first time axis information based on the music data. In Step S203, the second time axis information generation section 603 generates second time axis information based on the musical score data. In Step S204, the mode determination circuit 604 determines whether the mode is a musical score tracking mode or a musical score browsing mode. Although Step S204 shows an example in which a determination is made whether the mode is the musical score tracking mode, separate determinations can be made as to whether the mode is the musical score tracking mode or the musical score browsing mode.

When it is determined that the mode is the musical score tracking mode, the display controller 605 controls the display 101 to display the first time axis information in Step S205 as discussed above, for example, with regard to FIG. 10. In Step S206, the musical score display control circuit 607 controls the display 101 to display a musical score based on the musical score data. In Step S207, the designated position information acquisition circuit 608 acquires designated position information on the musical score that is designated by the user in Step S207. In Step S208, the designated position information display circuit 609 causes the musical score display control circuit 607 to control the display 101 to display designated position identification information that indicates the designated position on the musical score that is displayed on the display 101. In Step S209, the mark position information acquisition circuit 310 acquires mark position information that represents the position that corresponds to the designated position information on the musical score in the first time axis information based on the position information that is acquired in Step S207. In Step S210, the display controller 605 controls the display 101 to display a predetermined mark in a position indicated by the mark position information in the first time axis information, and the process returns to Step S204.

On the other hand, when the mode determination circuit 604 determines in Step S104 that the mode is the musical score browsing mode, the display controller 605 controls the display 101 to display the second time axis information in Step S211 as discussed above, for example, with regard to FIG. 11. In Step S212, the display controller 605 controls the display 101 to display a musical score based on the musical score data. In Step S213, the designated position information acquisition circuit 608 acquires designated position information on the musical score that is designated by the user. In Step S214, the designated position information display circuit 309 causes the musical score display control circuit 607 to control the display 101 to display designated position identification information that indicates the designated position on the musical score as discussed above. In Step S215, the mark position information acquisition circuit 610 acquires mark position information that represents the position information that corresponds to the designated position information on the musical score in the second time axis information based on the designated position information that is acquired in Step S213. In Step S216, the display controller 305 controls the display 101 to display a predetermined mark in a position indicated by the mark position information in the second time axis information, and the processing returns to Step S204.

The present invention is not limited to the embodiment described above and may be replaced by a configuration that is substantially the same, a configuration that realizes the same action and effect, or a configuration that is capable of achieving the same object as the configuration shown in the above-described embodiment. For example, the process shown in FIG. 12 pertains to a case in which the second time axis information is generated after the first time axis information is generated. However, the first and second time axes can be generated in a different order or simultaneously. In addition, the first or the second time axis information can be generated after it is determined whether the mode is the musical score tracking mode or the musical score browsing mode, and the first or the second time axis information can be displayed according to whether the mode is the musical score tracking mode or the musical score browsing mode.

In addition, as described above, the first time axis information or the second time axis information is displayed depending on whether the mode is in the musical score tracking mode or the musical score browsing mode. However, the display controller 605 can control the display 101 to display the first time axis information or the second time axis information according to an instruction from the user, regardless of whether the mode is the musical score tracking mode or the musical score browsing mode. Also, the first time axis information and the second time axis information can be displayed simultaneously according to an instruction from the user.

General Interpretation of Terms

In understanding the scope of the present invention, the term "detect" as used herein to describe an operation or function carried out by a component, a section, a device or the like includes a component, a section, a device or the like that does not require physical detection, but rather includes determining, measuring, modeling, predicting or computing or the like to carry out the operation or function. The term "configured" as used herein to describe a component, section or part of a device includes hardware and/or software that is constructed and/or programmed to carry out the desired function. The terms of degree such as "substantially", "about" and "approximately" as used herein mean an amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A musical score display device comprising:

a controller, configured to control a display to display a musical score and one of the following with the musical score:

a first time axis corresponding to a performance of the musical score in which at least one repeat part of the musical score is played during the performance; and a second time axis corresponding to the musical score including at least one repeat sign.

2. The musical score display device according to claim 1, wherein the controller is further configured to control the display to display first repeat part identification information that indicates at least one position corresponding to the at least one repeat part.

3. The musical score display device according to claim 1, wherein the controller is further configured to control the display to display second repeat part identification information that indicates at least one position corresponding to the at least one repeat sign.

4. The musical score display device according to claim 1, wherein the controller is further configured to determine whether the musical score display device is operating in a musical score following mode, and to control the display to display the first time axis during the musical score following mode.

5. A musical score display method comprising:

controlling, by a processor, a display to display a musical score and one of the following with the musical score:

a first time axis corresponding to a performance of the musical score in which at least one repeat part of the musical score is played during the performance; and a second time axis corresponding to the musical score including at least one repeat sign.

6. The musical score display method according to claim 5, further comprising controlling, by the processor, the display to display first repeat part identification information that indicates at least one position corresponding to the at least one repeat part.

7. The musical score display method according to claim 5, further comprising controlling, by the processor, the display to display second repeat part identification information that indicates at least one position corresponding to the at least one repeat sign.

8. The musical score display method according to claim 5, further comprising determining, by the processor, whether the musical score display device is operating in a musical score following mode; and wherein the controlling controls the display to display the first time axis during the musical score following mode.

* * * * *